US005146759A

United States Patent [19]

Eguchi et al.

[11] Patent Number: 5,146,759

[45] Date of Patent: Sep. 15, 1992

[54] METHOD FOR RAPID DIRECT COOLING OF A HOT-ROLLED WIRE ROD

[75] Inventors: Toyoaki Eguchi; Noriyoshi Ohwada; Yutaka Sagae; Katsumi Ito, all of Tokyo, Japan

[73] Assignee: Toa Steel Co., Ltd., Tokyo, Japan

[21] Appl. No.: 404,874

[22] Filed: Sep. 8, 1989

[30] Foreign Application Priority Data

Sep. 16, 1988 [JP] Japan ..... 63-229864
Mar. 1, 1989 [JP] Japan ..... 1-046625

[51] Int. Cl.[5] ..... C21D 1/62; F25D 17/02

[52] U.S. Cl. ..... 62/64; 134/14; 148/125; 266/259

[58] Field of Search ..... 62/64, 374; 148/125; 266/114, 259; 134/14, 131

[56] References Cited

U.S. PATENT DOCUMENTS 3,339,373 9/1967 Mobius et al. ..... 62/64
4,168,993 9/1979 Wilson et al. ..... 266/259 X
4,407,487 10/1983 Wang ..... 266/259 X

FOREIGN PATENT DOCUMENTS 0132796 11/1978 German Democratic Rep. ..... 266/259

*Primary Examiner*—William E. Wayner
*Attorney, Agent, or Firm*—Frishauf, Holtz, Goodman & Woodward

[57] ABSTRACT

A method for the rapid, direct cooling of a hot-rolled wire rod comprising the steps: transporting a hot-rolled and coiled wire rod on a conveyor, the wire rod being in a form of continuous series of loops; and blasting an air-water mist to the wire rod and simultaneously blasting air to the back side of the wire rod from below to cool the wire rod at a rate of 10° to 100° C./sec, while transporting the wire rod on the conveyor, the air-water mist providing 0.5 to 10 $m^3$/minute water and having an air to water ratio of 200 $Nm^3/m^3$ or less. Furthermore, a method for the rapid, direct cooling of a hot-rolled wire rod comprising the steps of: transporting a hot-rolled and coiled wire rod on a conveyor, the wire rod being in a form of continuous series of loops, advancing the wire rod in a zigzag configuration during the transportation and blasting an air-water mist to the wire rod and simultaneously blasting air to the back side of the wire rod from below to cool the wire rod at a rate of 10° to 100° C./sec, while transporting the wire on the conveyor, the air-water mist providing 0.5 to 10$m^3$/minute water and having an air to water ratio of 200 $Nm^3/m^3$ or less.

33 Claims, 14 Drawing Sheets

CENTER
0°
30°
60°
90°
120°
150°
180°
100
90
80
70
60
50
TENSILE STRENGTH (kgf/mm2)
TEST NO. 7

TEST NO. 8

TEST NO. 10

METHOD FOR RAPID DIRECT COOLING OF A HOT-ROLLED WIRE ROD

BACKGROUND OF THE INVENTION

1. Field of the Invention

The present invention relates to a method for direct cooling of a hot-rolled wire rod.

2. Description of the Prior Art

At present, as a controlled cooling method of a hot-rolled wire rod, the Stelmor method is a typical method which is now widely used. In this Stelmor method, a wire rod having been hot-rolled at a temperature of 850° C. to 900° C. is firstly coiled into a form of series of loops by a coiler, and the wire rod is dropped and introduced to a conveyer and is transported thereon in a form of series of loops. And then, the wire rod is forced to rapidly be cooled by an air-blast at a rate of 10 m to 50 m/sec. from the back side of the conveyor during the transportation, thereby to strengthen the wire rod.

The capability of the cooling depending on such air blast cooling, however, is limited, of itself, to a certain extent. When it comes to a wire rod, for example, of 11 mm in diameter, the speed of this air blast cooling becomes so low as to be approximately at a rate of 5° to 10° C./sec. When a wire rod of high carbon steel is produced by this air blast cooling, because of the low speed of the air blast cooling, the wire rod is reduced to being low in strength, as well as ductility, compared with that which is produced in off line lead patenting. Furthermore, when a wire rod of low or medium carbon steel with a so called supercooling structure such as bainite or martensite is to be produced, it is indispensable to add to the steel elements such as Mn, Cr and Mo for improving hardenability. This addition is also disadvantageous in increasing production cost. In the case of direct hardening of stainless steel, a wire rod with a mild property cannot be produced because, due to its slow speed of cooling, carbides are precipitated during the cooling process.

As prior art means to cover this disadvantage, various methods, for example, a method have been proposed of using a warm water or salt bath as the direct patenting method, or a method of putting a hot-rolled wire rod into a water bath as a direct quenching. But, by means of the warm water, a speed of this water cooling cannot match that of the lead patenting and by the salt bath, the dissolving of the salt requires such a time that the running cost is increased. As to the water bath method, it cannot be employed for multi-purpose use.

Furthermore, various methods of increasing the cooling capability of the Stelmor method have been disclosed in Japanese Patent publications. Namely, (1) in Japanese Patent Application Laid Open (KOKAI) No. 112721/76, water of 0.01 to 0.05 l/air blast of 1.0 $m^3$ is used for a spray; (2) in Japanese Patent Application Laid Open (KOKAI) No. 138917/78, an air blast which is mixed with water of 0.06 to 0.27 l/$Nm^3$ into mist is used; (3) in Japanese Patent Application Laid Open No. 214133/87 (KOKAI), moisture is blown away by means of hot air after a wire rod is rapidly cooled by using spray water; and (4) in Japanese Patent Application Laid Open No. 31831/84 (KOKAI), groups of water cooling nozzles are placed above conveyer rollers, the upper surface of an air-cooling chamber is sloped along the direction of conveying the wire rod, and water cooling is carried out, the water being discharged away into both sides of the conveying direction. Furthermore, some concepts of methods and apparatuses for the cooling in said Japanese Patent Application Laid Open Nos. 214133/87 and 31831/84 are suggested.

These prior art methods, however, are disadvantageous in several points. The prior arts mentioned in above (1) and (2) describe a method wherein a wire rod having its loops overlapped is simply applied to rapid cooling, which does not solve the problem of keeping the cooling speed constant and uniformly cooling the wire rod. The prior art described in above (3) is that a wire rod with its loops overlapped are only rapidly cooled from the above. Therefore, this art also fails to solve the aforesaid problem. In addition, this art blows away drops of water on the wire rod after the rapid cooling. But, in the case of a supercooling wherein such drops of water which are required to be blown away remain on a wire rod after cooling, structures of bainite or martensite are inevitably formed. As a result of this, the ductility of the wire rod becomes poor. Furthermore, in the prior art method cited in (4), the cooling is carried out exclusively by means of water cooling from above and the water is discharged to an off line, and therefore, the cooling from below makes no difference from that done conventionally. The concepts of the methods and the apparatuses mentioned above in respect of the Patent Application Laid Open Nos. 214133/87 and 31831/84 do not show specific ideas and therefore, fail to teach how to obtain uniform cooling speed.

SUMMARY OF THE INVENTION

It is an object of the present invention to provide a method for producing a wire rod having excellent strength and ductility, by providing a uniform cooling speed.

To attain the object, in accordance with the present invention, a method is provided for the rapid direct cooling of a hot-rolled wire rod, comprising the steps of:

transporting a hot-rolled and coiled wire rod on a conveyer in a state that said wire rod is in a form of continuous series of loops; and blasting an air-water mist to said wire rod and blasting air to the back side of said wire rod from below to cool said wire rod at a cooling rate of 10° to 100° C./sec. during the transportation, said air-water mist having an air to water ratio of 200 $Nm^3/m^3$ or less which is prepared from water of 0.5 to 10 $m^3$/min.

Furthermore, in accordance with the present invention, another method is provided for rapid direct cooling of a hot-rolled wire rod, comprising the steps of:

transporting a hot-rolled and coiled wire rod on a conveyer in a state that said wire rod is in a form of continuous series of loops; and blasting spray-water to said wire rod and blasting air to the back side of said wire rod from below to cool said wire rod at a cooling rate of 10° to 100° C./sec. during the transportation, said spray-water being fine particles which are prepared from water of 0.5 to 10 $m^3$/min. by means of spraying.

Furthermore, in accordance with the present invention, a further method is provided for rapid direct cooling of a hot-rolled wire rod, comprising the steps of:

transporting a hot-rolled and coiled wire rod on a conveyer in a state that said wire rod is in a form of continuous series of loops, having said wire rod advanced in zigzag configuration during the transportation; and blasting air-water mist to said wire rod and blasting air to the back side of said wire rod from below to cool said wire rod at a cooling rate of 10° to 100° C./sec. during the transportation, said air-water mist having an air to water ratio of 200 $Nm^3/m^3$ or less which is prepared from water of 0.5 to 10 $m^3$/min.

Still furthermore, in accordance with the present invention, a further method is provided for rapid direct cooling of a hot-rolled wire rod, comprising the steps of:

transporting a hot-rolled and coiled wire rod on a conveyer in a state that said wire rod is in a form of continuous series of loops, having said wire rod advanced in zigzag configuration during the transportation; and blasting spray-water to said wire rod and blasting air to the back side of said wire rod from below to cool said wire rod at a rate of 10° to 100° C./sec. during the transportation, said spray-water being fine particles which are prepared from water of 0.5 to 10 $m^3$/min. by means of spraying.

The object together with other objects and advantages which will become subsequently apparent reside in the details of construction and operation as more fully hereinafter described and claimed, reference being had to the accompanying drawings forming a part of hereof.

BRIEF DESCRIPTION OF THE DRAWINGS

FIG. 1(*a*) being a front elevational view of the apparatus; FIG. 1(*b*) a plan view thereof and FIG. 1(*c*) is a side elevational view thereof; FIG. 1(*d*) is a front elevational view of the apparatus which depicts blasting the air-water mist from below, as well as from above the wire-rod

FIG. 10(*b*) a front view thereof and FIG. 10(*c*) a sectional view thereof taken on line X—X in (b);

FIG. 11(*a*) being a case of the present invention and FIG. 11(*b*) a case of a prior art method;

FIG. 12(*a*) being a case of the present invention and FIG. 12(*b*) a case of a prior art method;

DESCRIPTION OF THE PREFERRED EMBODIMENT

The fundamental feature of the present invention lies in a method making use of an improvement in the equipment and facilities of the Stelmor method, wherein mist nozzles for producing air-water mist are placed above a conveyor of a hot-rolled wire rod or below the conveyer, by means of a pressure spray with a predetermined water flow and an air-water ratio through the mist nozzles to produce a fine air-water mist and the hot-rolled wire is rapidly cooled by a combination of the produced fine air-water mist and blast air from below the hot-rolled wire rod during the transportation of the hot-rolled wire rod.

Firstly, the reasons why the cooling conditions are numerically defined in the present invention will now be described.

The water flow ranges from 0.5 to 10 $m^3$/min. If the water flow used for the cooling mist is less than 0.5 $m^3$/min., the cooling speed is not high enough to produce a product with a desired structure, i.e., martensite or bainite or ferrite and pearlite. Contrarily, if it is over 10 $m^3$/min., the water flow is not economically effective.

The air-water ratio represented by air/water is 200 $Nm^3/m^3$ or less. If the air-water ratio is over 200 $Nm^3/m^3$, water particles existing in a unit volume are too short to cool a hot-rolled wire rod, i.e., the cooling capability is not satisfactory.

The cooling speed is 10° C./sec. or more. If the cooling speed of a hot-rolled wire rod is less than 10° C./sec., it fails, not only in strengthening the strength of carbon steel, but also for softening the property of stainless steel. Furthermore, the blast air usually ranges from 10 to 60 m/sec. If the blast air is less than 10 m/sec., the wire rod is not cooled uniformly. If it is over 10 m/sec., the power cost is expensive and a uniform spread of the air-water mist is not obtained. It should be noted that the cooling speed ranges from 10° to 100° C./sec. practically in operation, although, because the present invention aims at obtaining the cooling speed of water cooling as much as possible, there is no upper limit of the cooling speed.

Figure 2:
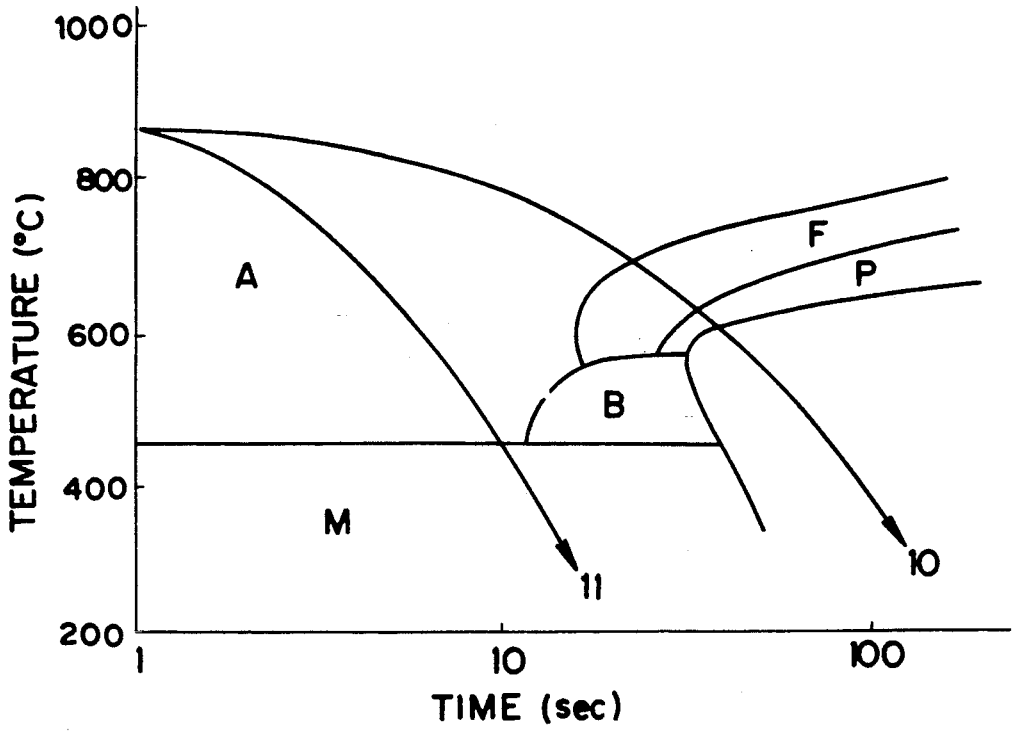
FIG. 2 is a graphic representation showing a cooling curve of the present invention and that of the prior art Stelmor, in combination with a transformation curve of steel drawn thereon.

FIG. 2 graphically shows transformation curves of Mn-B steel with 0.2 wt. % C and to 1.3 wt. % Mn and cooling curves drawn thereon. Curve (10) represents a cooling curve when the Stelmor method is applied and curve (11) represents a cooling curve when the method of the present invention is applied. In the case of the Stelmor method, the cooling speed is slow and the structure which is produced after transformation is ferrite and pearlite, while in the case of the present invention method the produced structure is martensite. A wire rod with a high strength is produced. In this Figure, F represents ferrite, P pearlite, B bainite and M martensite.

Figure 3:
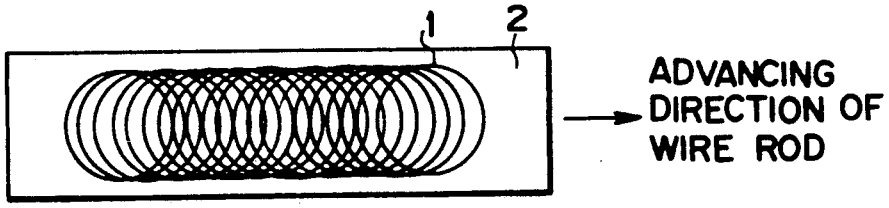
FIG. 3 is a schematic plan view illustrating a overlapping state of continuous series of loops which a wire rod has according to the present invention.

FIG. 3 illustrates a plan view of a conventional overlap state of continuous series of loops of a wire rod 1 which have been hot-rolled. On both sides of the conveyer, the overlap of the loops are frequent and therefore, the overlap becomes thick, while in the neighborhood of the center line portion, the overlap is rare. Consequently, the rare overlap parts in the neighborhood of the center line portions can be cooled at a considerably less deviation of the cooling speed by compulsive cooling either from above or below. But, so far as the thick overlap parts are concerned, even if the cooling is made simply either from above or from below, this one side cooling cools one side of the loops, failing to cool most of the other side thereof. Therefore, the cooling speed becomes greatly imbalanced and resultantly the structure and strength are much ill-balanced. To prevent this ill-balance, the compulsory cooling from both above and below is performed. In the present invention, air-water mist from above and blast air from below are simultaneously applied to the wire rod. In this simultaneous cooling, water included in the air-mist from above mixes into the blast air from below and the blast air actually turns into a blast air-mist. The cooling of the present invention effects mist cooling of the wire rod both from above and below. It is important is to have the blast air include mist. For this purpose, mist nozzles are installed below the wire rod to have mist mixed into the blast air. Furthermore to strengthen the cooling of the thick portions of the overlap loops, mist can be horizontally blasted to the thick portions. Seemingly in general, it looks like blast air from below blows off mist coming from above thereby to lose the effect of the mixture of the mist, but in fact this is not so. This is because the air-water mist hits above from such a short distance as about 400 mm and therefore, the flow speed of the air-water mist is high enough to exceed that of the blast air. The air-water mist is not beaten by the blast air.

In the present invention, the temperature of water to be supplied is controlled within a range of 10° to 30° C. as the case may be required or the temperature of the wire rod at the entrance of a third cooling zone is controlled. When a cooling tank is installed in the open air, because of the water temperature being deviated about 40 degrees from the temperature of 0° C. or less, it causes an imbalance of the strength and ductility of the wire rod in the case that the temperature of the wire rod is controlled by means of the amount of water. The range of 10° to 30° C. can be obtained without waste of extra-energy for the control. It should be noted that the cooling rate is controlled by measuring the temperature of the wire rod, since water temperature is affected by the open air temperature or the like in spite of such water temperature being in the range.

Figure 16:
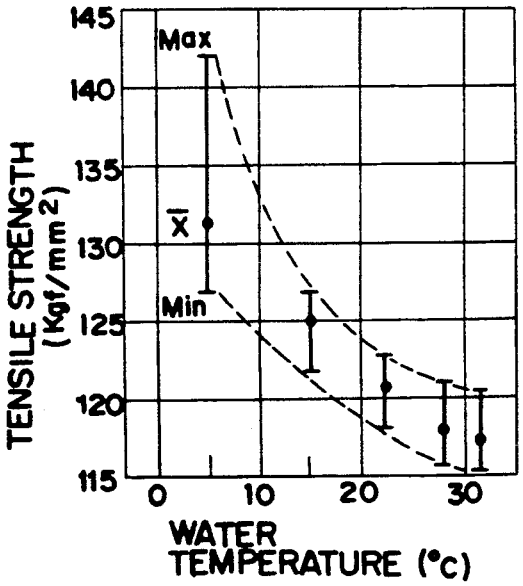
FIG. 16 is a graphic representation showing the relation between the temperature of cooling water and the strength of a wire rod of the present invention.

FIG. 16 graphically shows the influence on the strength of a wire rod by water temperature when it varies based on the condition shown in Table 5 described later herein. This suggests that in the case of the water temperature being lower than 10° C., the wire rod is over-cooled by means of leaving the wire rod to the open air and that in the case of the water temperature being over 30° C. the cooling speed is slow enough to lessen the strength.

Figure 17:
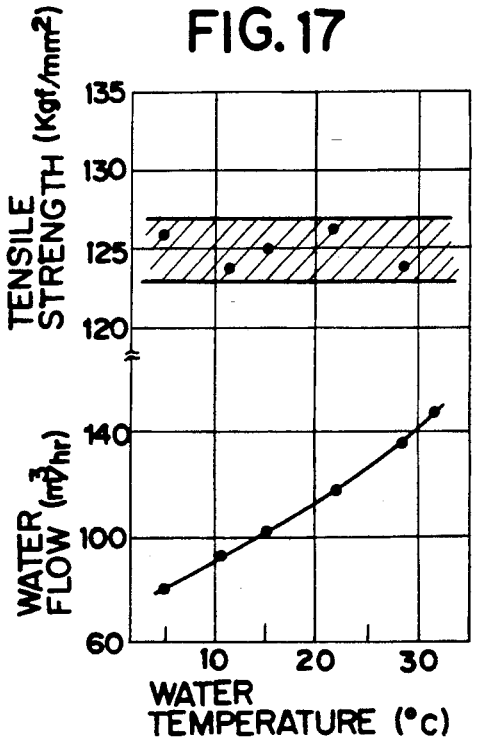
FIG. 17 is a graphic representation showing the relation between the cooling water flow and temperature of a wire rod of the present invention, when a temperature at an entrance into a third cooling zone is constant.

FIG. 17 graphically shows an example of control by means of measuring the temperature of a wire rod which has been rapidly cooled. In this example, the temperature at the entrance of the third cooling zone is controlled to range from 430° to 460° C. and the strength is not deviated. The temperature after rapid cooling is controlled, by adjusting the amount of the air-water mist, to range within a desired temperature of ±20° C.

As mentioned above, in the present invention, a method is taken wherein the temperature of water to be supplied is controlled in advance or the supply amount of water is controlled by measuring the temperature of the wire rod at the entrance of the third cooling zone. Of course, the temperature range should be rearranged for the control, depending on the steel grade of the wire rod.

Figure 10:
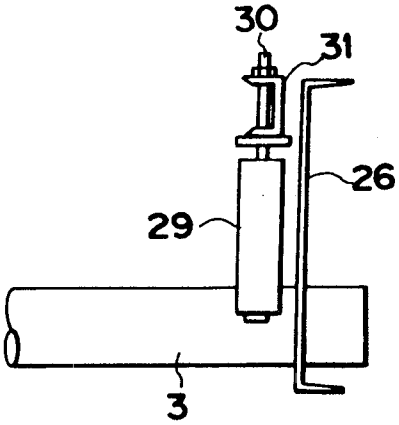
FIGS. 10(*a*) to (*c*) are views illustrating a structural mechanism for pushing in a wire rod, FIG. 10(*a*) being a plan view of the structural mechanism.
Figure 10:
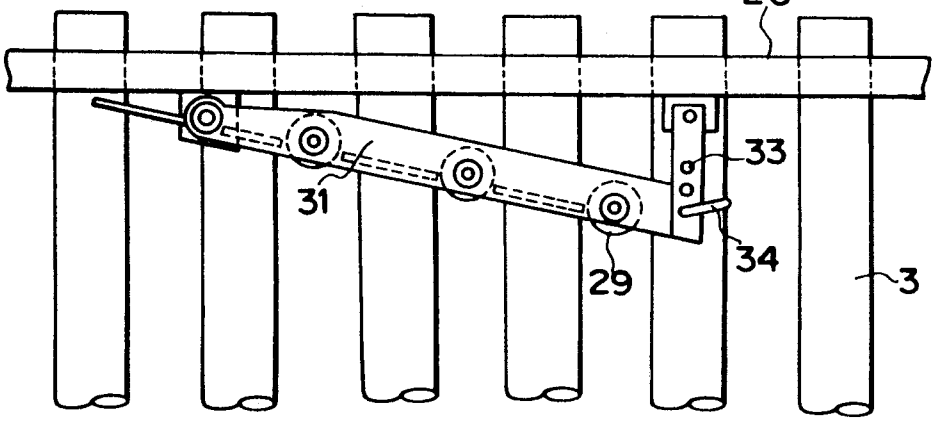
Figure 10:
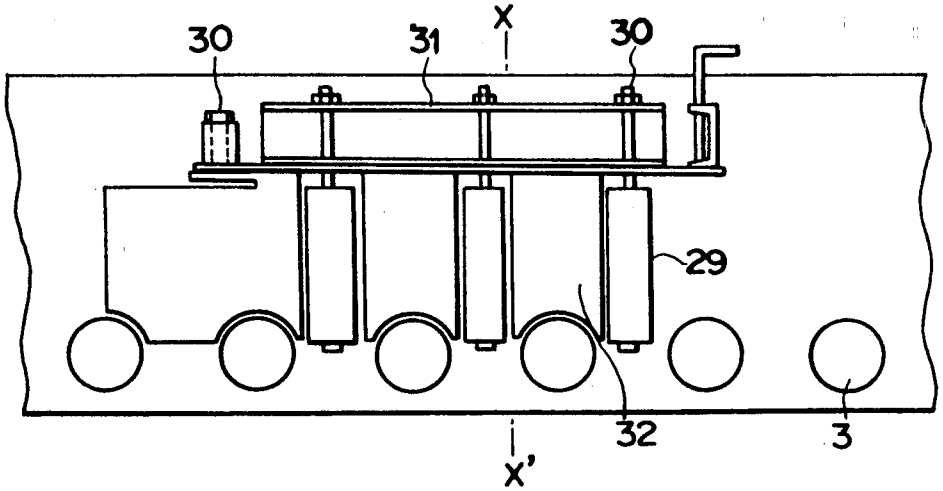
Figure 11:
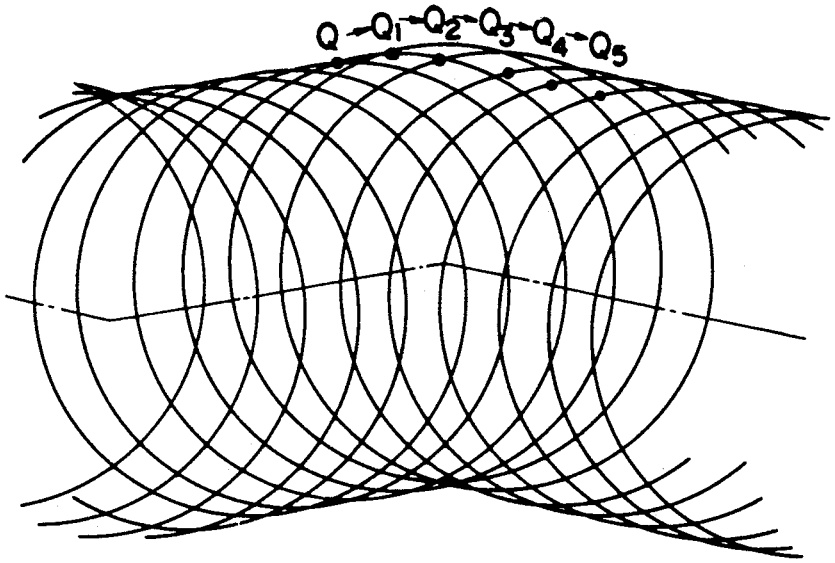
FIGS. 11(*a*) and (*b*) show schematic views illustrating an overlapping state of loops formed continuously in series by a wire rod during the transportation of the wire rod.
Figure 11:
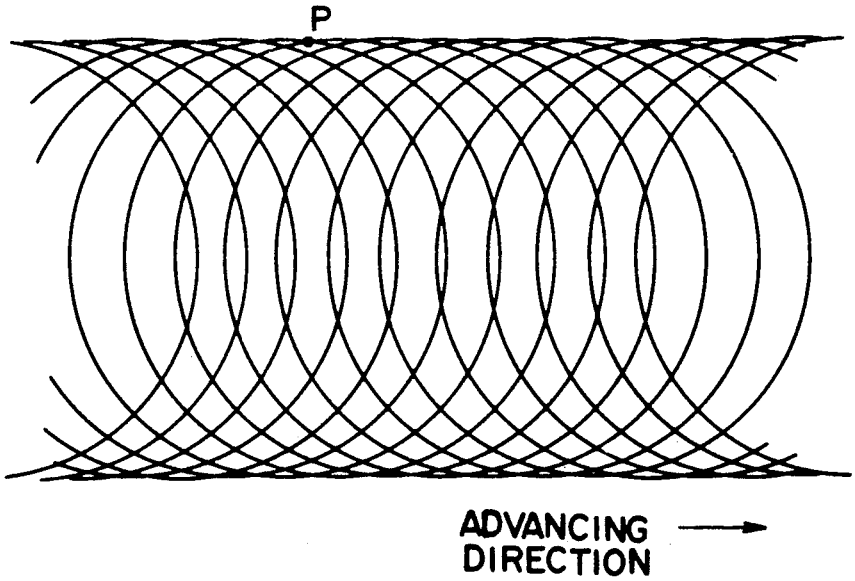
FIG. 11 (b) PRIOR ART

Furthermore, to perform a successful operation, in stead of transporting a wire rod, in a state that several loops of wire rods are overlapped, from the first cooling zone to the fourth cooling zone as the loops advancing straight in the present invention, pushing mechanisms, each, are placed, in turns, at each of the side walls of the conveyer to have each of the contact points of the loops slided on one another. FIG. 10 illustrates schematic views of the pushing mechanism. As shown in FIG. 10(*a*), the pushing mechanism comprises an angle 31 to which several small size rollers 29 are vertically fixed, the mechanism being placed closely along each of the side walls 26 so as to have the loops pushed towards the other side so that the loops of the wire rod which are coming forward can be guided to advance in a zigzag configuration on a conveyer. Small size rollers are used so as to make a small touch resistance between the loops and the pushing mechanism and to keep the surface of the loops harmless during the zigzag movement. Furthermore, the angle 31 is joined to one of the side walls 26 through a piece plate with a plurality of interval arrangement holes 33 for a pin 34. A wave length of the zigzag movement to be formed by the loops of the wire rod is arranged by means of making use of a selection of the interval arrangement holes 33 which the pin 34 is inserted into. The details of the embodiment will be described later in the Example of the present invention. FIG. 11(*a*) schematically illustrates that an initial overlap point "P" is shifted gradually to from "$Q_1$" to "$Q_5$". In this manner, this pushing mechanism can carry out the zigzag movement with a small touch resistance and the simple interval arrangement for the zigzag advancement angle.

Figure 14:
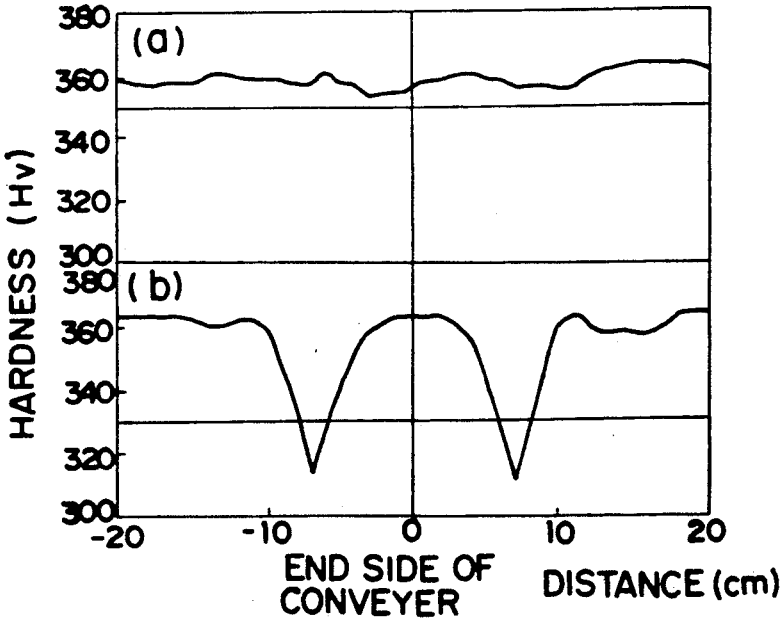
FIG. 14 is a graphic representation showing hardenability of overlapping portions of loops formed continuously in series by a wire rod according to the present invention.
Figure 15:
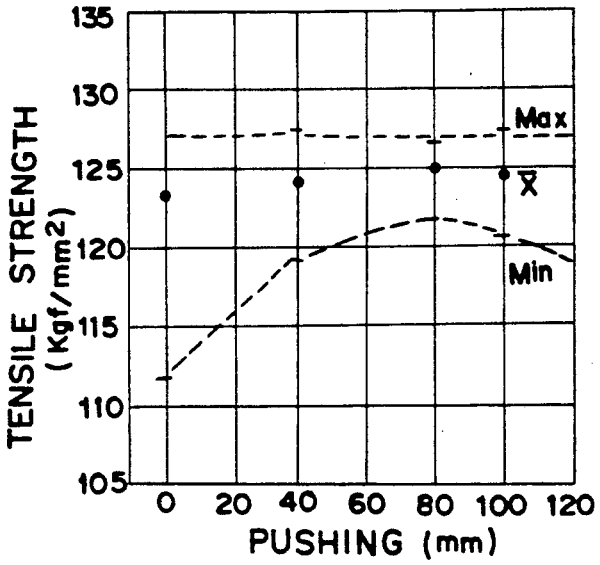
FIG. 15 is a graphic representation showing the relation between deviations of strength and pushing length of loops of a wire rod produced by a pushing structure according to the present invention.

FIG. 14 graphically shows the distrbution of hardness of thick over-lap portions of the loops, (a) representing the case of making use of a pushing mechanism and (b) representing the case of not making use of the pushing mechanism. From this comparison, "case (a)" i.e. "use of the pushing mechanism" provides a much greater effect of making the cooling of the wire rod uniform than Case (b) i.e. "no use of the pushing mechanism". Case (a) represents a test sample No. 4 of the present invention and case (b) represents a Controller No. 5, which will be explained later herein. FIG. 15 graphically shows the relation between pushing length and deviation of strength of the wire rod, on the condition of cooling shown in Table 5 (d) and (e) hereinafter described. The deviation is reduced to one second of that of no pushing at a pushing length of 40 mm and is minimized at a pushing length 80 mm. But, the deviation increases a little bit at a pushing length 100 mm. This is because the transport resistance increases due to the increase of the pushing length, a pitch of loops becomes small and the isolation of the thick over-lap portions becomes insufficient. Therefore, the pushing length preferably ranges 30 to 100 mm. Furthermore, considering that the aim of the pushing mechanism of the present invention is to have the thick over-lap portions of the loops of the wire rod which are formed continuously in series slided gradually, instead of the small size rollers, belts woven from thin wires can be rotated in harmony with the advancing speed of the wire rod to push the wire rod. In addition, such a method as electromagnet or gradual inclination of axes of conveyer rollers can be used as an alternative thereof.

Furthermore, in the third to fourth cooling zones already mentioned a heat-retaining cover is used to cause recuperation of the wire rod or slow cooling at a rate of −2° C./sec. to 3° C./sec. as the case may be. When a wire rod with a small size is patented in the winter season having a climate in Japan and only when there is fear of the occurrence of supercooling martensite included in the wire rod, the heat-retaining cover is used as mentioned above. The cooling speed at a rate of less than −2° C./sec. has a danger of producing a supercooling structure and the recuperation at a rate of over 3° C./sec. requires extra-time and extra-energy. In direct patenting of the wire rod, if the temperature at the entrance of the third cooling zone is 450° C., it is well to attain the purpose of the direct patenting that the temperature at the exit of the final cooling zone has only to be elevated to 500° C.

The wire rod is received in a reforming tub and cooled therein. Therefore, even if some austenite which has not yet transformed remains in the wire rod, that causes no problem so long as a supercooling structure is not produced in the process from the third cooling zone to the reforming tub. Furthermore, a heating mechanism installed in said zone area can be used for tempering the wire rod. In the Examples hereinafter described, four blowers are used for sending blast air, but the number of the blowers can be increased or decreased, depending on the cases.

In the Example using a cooling bed of 1.6 m×9.0 m hereinafter given, water of 30 to 300 $m^3$/hr is necessary. In this Example, air-water nozzles preferably ranges from 50 to 300 in number. If the number is less than 50, the cooling capacity is unsatisfactory. Furthermore, 10 to 40 pairs of an air supply conduit and a water supply conduit are required to be arranged at a predetermined interval to have the thick over-lap portions of the loops of the wire rod cooled repeatedly 1.5 to 4.0 times as much as the rare over-lap portions of the loops of the wire rod passing in the neighborhood of the center line on the conveyer.

EXAMPLE-1

Figure 1:
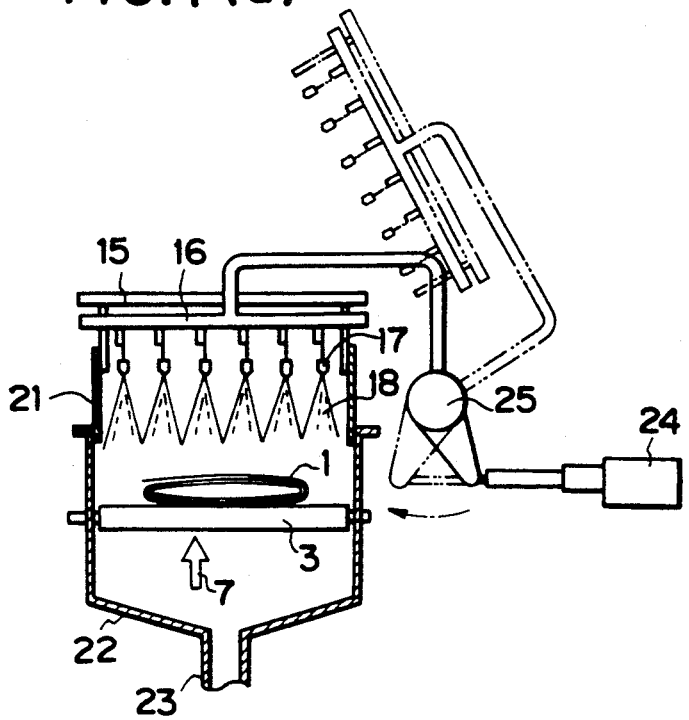
FIGS. 1(*a*) to (*d*) shows views of an embodiment of an apparatus wherein a method of the present invention is carried out.
Figure 1:
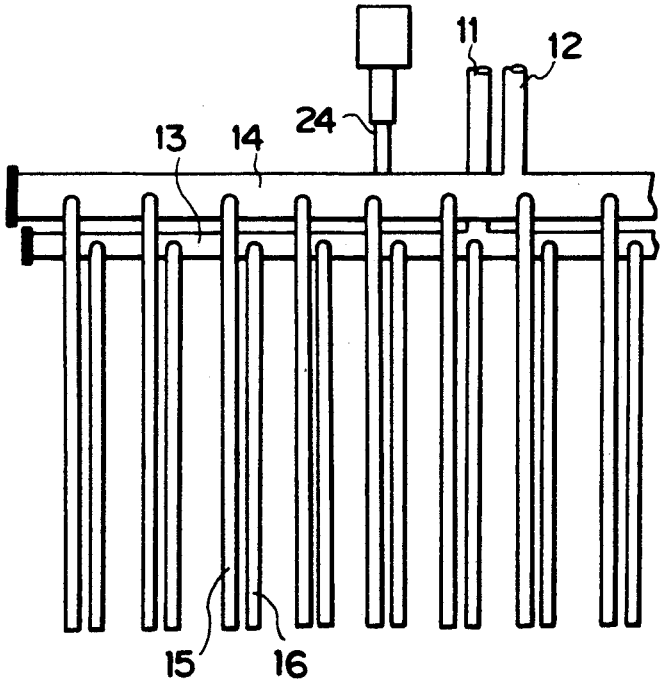
Figure 1:
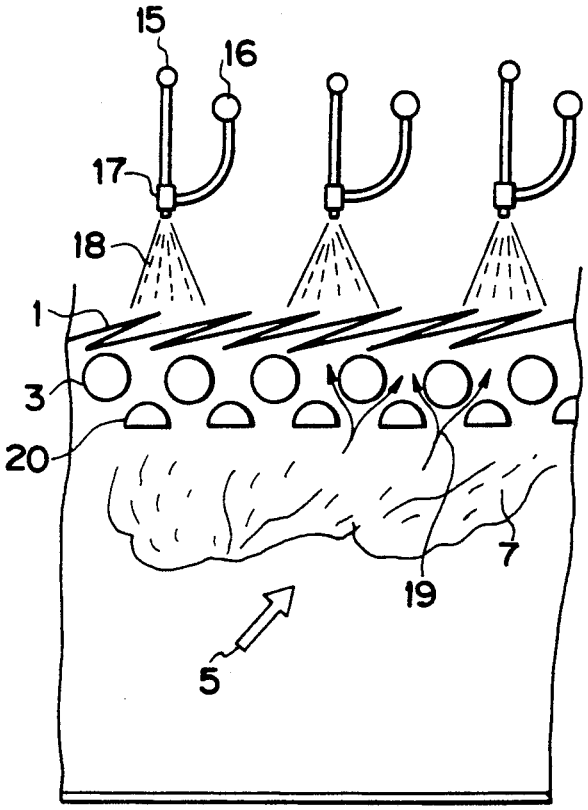
Figure 1D:
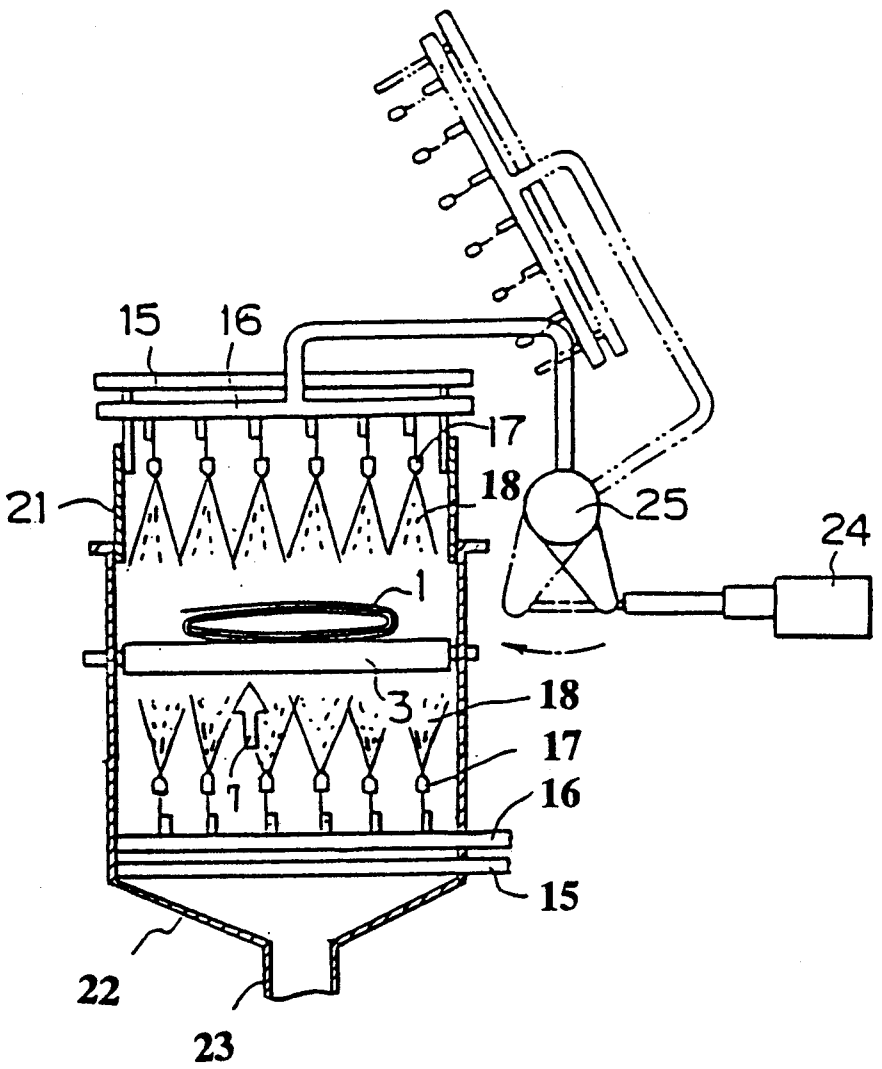

In this EXAMPLE, a method of the present invention without using a pushing mechanism will be explained. FIG. 1 shows an apparatus for practicing a method for rapid direct cooling of a hot-rolled wire rod of the present invention, FIG. 1(*a*) represents a front view of the apparatus, FIG. 1(*b*) a plan view thereof and FIG. 1(*c*) a side elevation view thereof. Referential numeral 1 denotes a hot-rolled wire rod, 3 a conveyer, 5 blast air, 7 air-blast mist, 13 a water head pipe, 14 an air header pipe, 15 a water supply conduit, 16 an air supply conduit, 17 an air-water spray nozzle, 18 air-water mist, 19 flow of blast mist, 20 rectifier plate, 21 a side mist splash protector, 22 a blast air chamber, 23 a water guide, 24 an electrically powered cylinder, and 25 a rotary axis.

Water supplied through the water supply conduit 15 and air through the air supply conduit 16 are mixed into air-water mist and the air-water mist turns into the air-water mist 18. Then, the air-water mist cools the hot-rolled wire rod from above, the wire rod being transported on the conveyer 3 in an overlapping state of series of loops of the wire rod. The blast air 5 is blown to the wire rod 1. Thus, the wire rod 1 is compulsorily cooled simultaneously from both above and below. The amount of the air-water mist to be spread over portions of the rare over-lap parts of the loops passing around the center line of the conveyer 3 was controlled to be small and amount of the air-water mist to be spread over portions of the thick over-lap parts of the loops passing around the both sides of the conveyer 3 was controlled to be large, depending on over-lap degree of the overlap of the loops. To perform this type of cooling, above the upper side of the wire rod, the amount of the air-water spray nozzle was installed in the neighborhood of the both side much more than in the neighborhood of the center line to have the over-lap loops of the wire rod cooled in uniform speed. The air-water mist, coming down from above, got involved in an up-flow of the blast air 5 and, resultantly the wire rod was rapidly cooled by the air-water mist.

Figure 8:
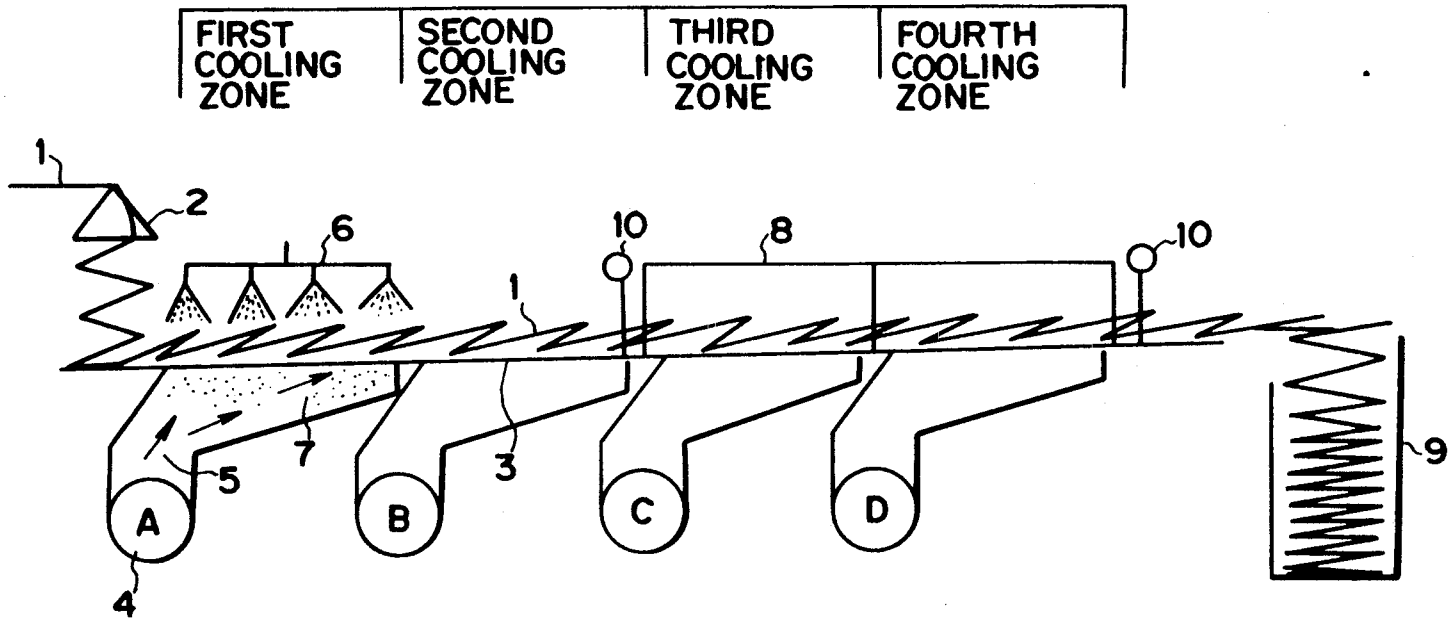
FIG. 8 is a schematic sectional view illustrating wholly the apparatus shown in FIG. 1 along the advancing direction of a wire rod.

FIG. 8 schematically illustrates a sectional view of the apparatus shown in FIG. 1 along the advancing direction of the wire rod 1, A, B, C and D denoting each of four blowers 4 for the blast air. A cooling zone area consisting of the first through the fourth cooling zone ranges from below the coiler 2 to a point where a thermometer 10 is set. The third cooling zone and the fourth cooling zone are covered respectively by each of heat-retaining covers 8 and in these two zones, slow cooling or recuperation which includes heating is carried out.

Furthermore, in FIG. 8, an air-water spray device 6 is placed above the wire rod 1. Through the air-water spray device, air-water mist is injected and blast air 5 from below is mixed with the air-water into the blast mist 7. In this FIG. 8, the conveyer 3 is illustrated by a line for simplicity, but the conveyer 3 is a roller conveyer as shown in FIG. 1. The air supply conduit 15 and the water supply conduit 16 are connected to the air-water spray nozzle 17 as shown in FIG. 1(*a*). Besides, it turns the air-water spray device over. Instead of the turn-over, it is possible to have the air-water mist device slid towards the side.

Figure 9:
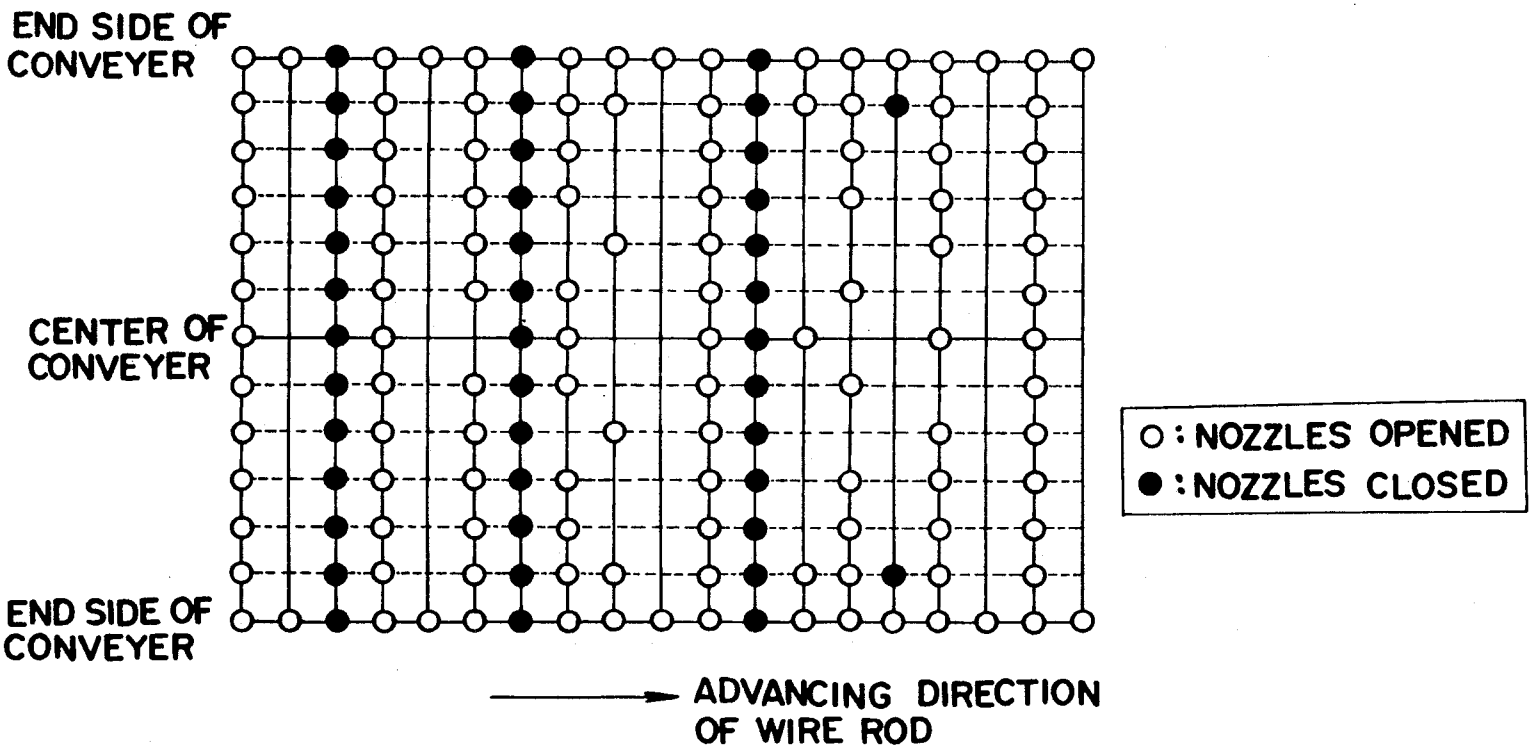
FIG. 9 is a view illustrating an arrangement layout of air-water spray nozzles according to the present invention.

FIG. 9 schematically illustrates a plan view of an arrangement layout of air-water spray nozzles in patenting a wire rod of the present invention. Air-water spray nozzles are layouted at right angles to an advancing direction of the wire rod in 13 lines and are layouted in paralell with the advancing direction in 19 rows, but the layout is scattered to meet an overlap degree of loops of the wire rod. The opening and closing of those air-water spray nozzles are carried out to meet such conditions as size of the wire rod, temperature of cooling water and cooling speed.

Symbol mark ○ denotes air-water spray nozzles which are opened and symbol mark ● air-water spray nozzles closed.

Now, examples of cooling the wire rod will be given, making use of the apparatus shown in FIG. 1. The chemical composition of sample materials used are shown in Table 1. Mn-B Steel and Mn-Cr-B Steel are materials for pre-stressed concrete steel wire rod. Low C-Si-Mn Steel is used for chain-pins and bolts. SUS 304 is austenite stainless steel. Table 2 shows the cooling conditions of samples of the present invention and Controllers. The area of a mist cooling zone is 1250 mm×1800 mm.

In Table 22, "a" is a Controller of the conventional Stelmor method; "b" is a Controller of a cooling method wherein the cooling is performed exclusively by means of air-water mist from above without using blast air; "c" is a Controller in case that water amount of mist is short; "d" is an Example of a method of the present invention wherein air-water mist and blast air is appropriately applied to a wire rod; "e" is a Controller wherein water amount is a little too much; "f" is a Controller wherein air-water mist is exclusively used. The results are shown in Table 3 by test Nos. For the measurement of the temperature of the wire rods, a radiation thermometer was used. For a tensile test, three loops were taken from each of three portions of one ton wire rod, the portions being the top end, the center and the tail end of the wire rod and each of the loops being divided equally into 24 parts. For observation of structure, an optical microscope was used, test samples being attacked by 2% natar or 10% oxalic acid.

The results of Table 3 will now be described. Test No. 1 is a Controller of the Stelmor method which was applied to a manufacture of a wire rod of Mn-B steel, which is used for pre-stressed concrete. The No. 1 Controller shows a very low tensile-strength. To obtain a high tensile-strength in the Stelmor method, as shown in test No. 6 of a Controller Mn-Cr-B steel was used and the strength was 150 kg f/mm. But, in test No. 4 of a method of the present invention, material of Mn-B steel was used and the wire rod marks a very satisfactory strength and shows also a deviation smaller than that of the Controller No. 6. In the case that low C-Si-Mn steel was used, the strength of test No. 10 of the present invention method is well higher than that of No. 4 whose Controller was produced by the Stelmor method. As far as SUS 304 steel was concerned, the Controller of test No. 12, which the Stelmor method was applied to, shows a high strength, because, due to the cooling being slow, carbide was precipitated during the cooling process. For this reason, in the prior art the solid solution treatment was required to be done in an off-line process. In contrast to this, as shown in test No. 15 of a method of the present invention, a wire rod of mild property could be produced without precipitation of C. In test Nos. 2, 8 and 13, the deviation of strength is large because blast air was not blown and therefore, one side of thick portions of overlap of the loops was exclusively cooled in rapid speed. Test Nos. 3, 9 and 14 show sufficient strength and mildness are not attained because, due to lack of water amount and a large air-water rate, the cooling speed is not satisfactory. Test Nos. 5, 11 and 16 are cases that supply of water was too much and in those cases the results are the same with those of Nos. 4, 10 and 15. Furthermore, if a wire rod of carbon steel is cooled more rapidly than necessary, the wire rod is easy to cause cracking. Test Nos. 17 to 21 were Examples of methods of the present invention, any of them marks desirable results in quality. From the foregoing, when 0.6 to 2.0 $m^3$/min. of water is used, it is preferable that air-water ratio ranges from 100 to 200 $Nm^3/m^3$ and when 2 to 8 $m^3$/min. of water is used, a water ratio of 15 to 50 $Nm^3/m^3$ is preferable. Furthermore, the cooling speed of 15° to 40° C./sec. is preferable. Even in the case of spray water cooling, 15° to 40° C./sec. is also recommendable.

Figure 4:
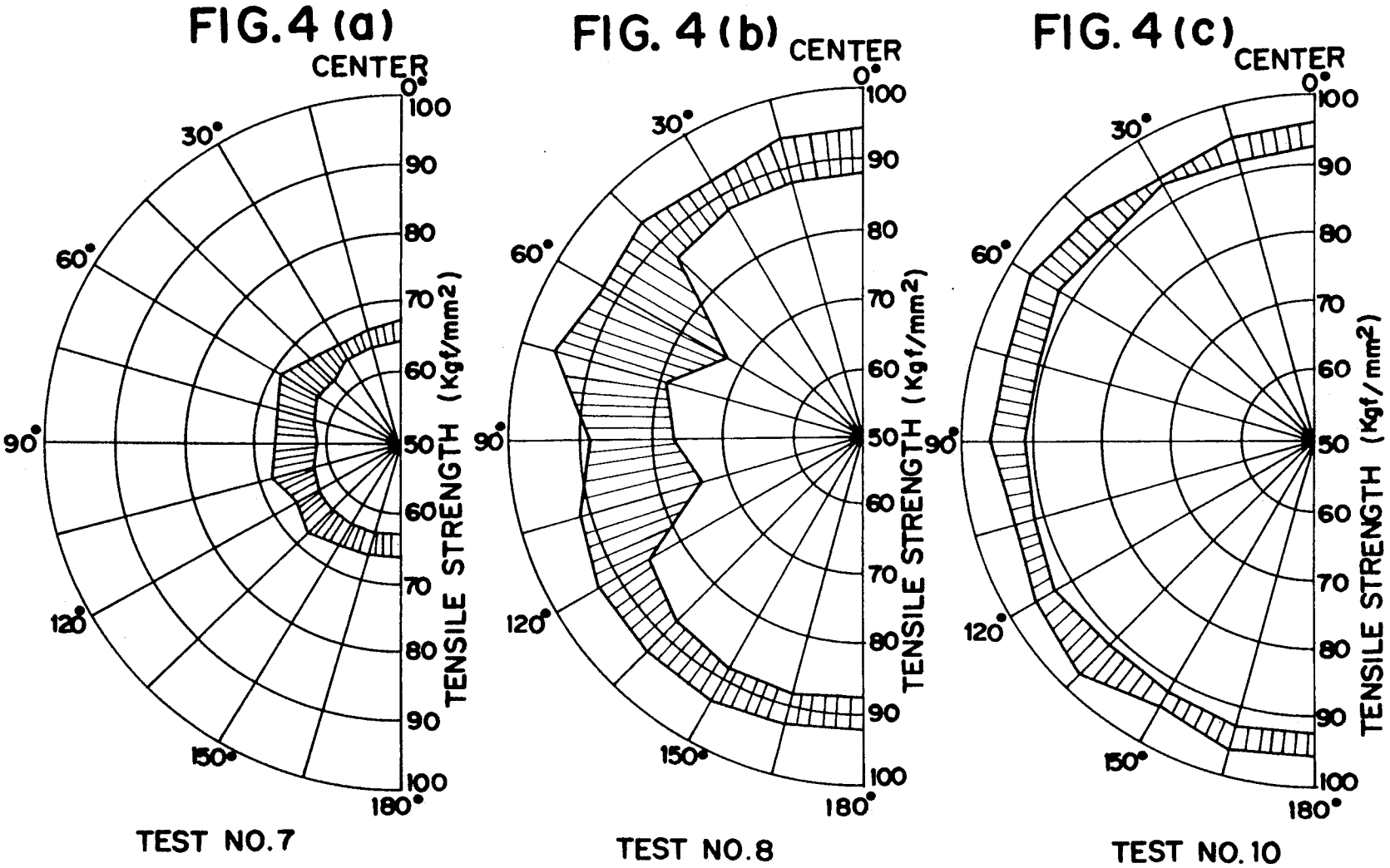
FIGS. 4(*a*) to (*c*) show deviations of strength located in a semi-circle area of one of loops continuously formed respectively by a wire rod of the present invention and Controller.

FIG. 4 shows deviations of strength positioned in semi-circles for each of a Controller and samples of the present invention in Test Nos. 7, 8 and 10. Angles of 0° and 180° are the center line of the conveyer 3 and 90° is the side end of the conveyer where the overlap is in the thickest portion. The Controller of No. 7 to which the Stelmor method was applied shows low strength. In the Controller of No. 8 to which the air-mist cooling from above only was applied, a large deviation of strength is seen in the neighborhood of 90° because the thick portion of the overlap was not uniformly cooled. In contrast, test No. 10 to which the air-water mist cooling from above and the blast air cooling from below were applied shows that a uniform high strength is located on the whole.

Furthermore, a method for cooling a wire rod was also studied wherein the wire rod was cooled by means of the air-water mist from below through mist nozzles which were placed to face the wire rod upwardly. The results of the study showed that the effect of this method makes no difference from that of the method of the present invention which was mentioned above.

Figure 5:
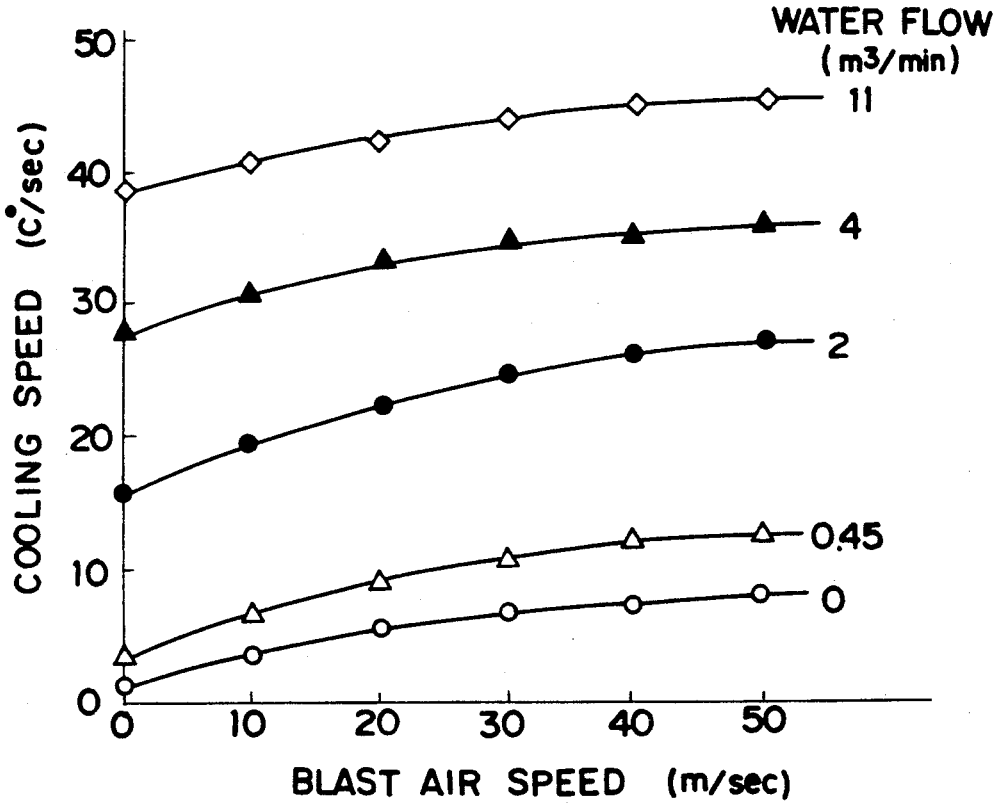
FIG. 5 is a graphic representation showing the relation between blasting speed-water flow and cooling speed to evaluate the conditions of the present invention.
Figure 6:
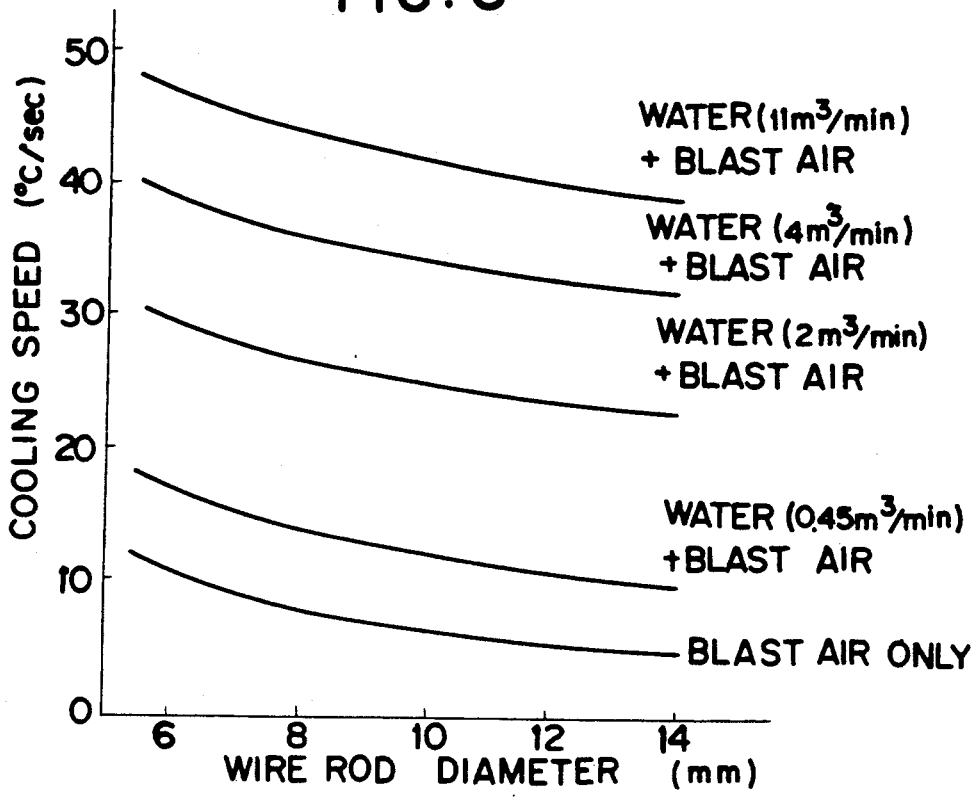
FIG. 6 is a graphic representation showing the relation between cooling speed of a wire rod and water flow to evaluate the conditions of the present invention, using an air blasting speed of 20 m/sec.

FIG. 5 graphically shows the relation between the speed of blast air and the cooling speed when water the flow ($m^3$/min.) was changed. For this test 9 mm wire rod in diameter was used. FIG. 6 also graphically shows the relation between the cooling speed and the size of a wire rod by changing the water flow in combination of blast air. From these representations it can be seen that when the cooling conditions of the present invention is applied, a cooling speed of 10° C./sec. or more is satisfactorily attained.

Figure 7:
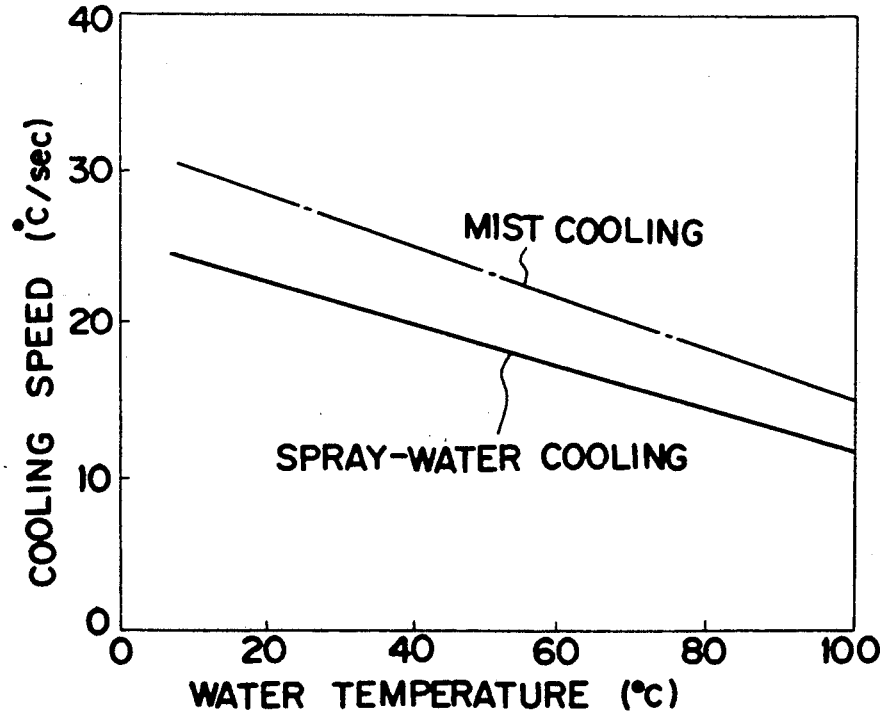
FIG. 7 is a graphic representation showing the relation between cooling speed of a wire rod and temperature of water, in respect of mist cooling and spray-water cooling, to evaluate the conditions of the present invention.

The above mentioned cases used water having a temperature of 15° to 30° C. But, a method of the present invention can use hot water or cold water of 15° C. or less. The relation to temperature of such cold water and cooling speed is summarized in a graphic representation in FIG. 7 in cases of air-water mist cooling and spray-water cooling. When warm water or hot water which is over 30° C. is used, it is possible to have the blasting power softened, which makes the cooling uniform, although the cooling capacity is dropped compared to the cooling by cold water. In either of the cases of water spray cooling and air-water mist cooling, generally speaking, if water flow is 0.5 $m^3$/min. or more, the cooling speed of 10° C./sec. or more can be obtained, which enables the attainment of the purpose of the present invention. If the temperature of the cooling water is 15° C. or lower, the cooling speed is further elevated.

EXAMPLE-2

In this EXAMPLE, a method of the present invention using a pushing mechanism will be mainly explained, although a method of the present invention without using the pushing mechanism is sometimes explained.

A pushing mechanism is illustrated in FIG. 10 as mentioned in the foregoing. A pushing length was 80 mm. 247 of air-water mist nozzles were used and operated at maximum in the first cooling zone. 41 of the 247 air-water nozzles were closed as shown in FIG. 4. FIG. 10(*a*) is a plan view of the pushing mechanism, FIG. 10(*b*) a front view of thereof and FIG. 10(*c*) is a section view thereof taken on line X—X' of FIG. 10(*b*). The view of FIG. 10(*a*) was as already mentioned in the foregoing description of the Preferred Embodiment. In the view of FIG. 10(*b*), the small size roller 29 is connected, through a bolt 30 as an axis, to the angle 31 placed fixedly to the side wall 26 of the conveyer 3. Piece plate 32 makes an interval between the neighboring small size rollers 29 as a blocking means.

Figure 12:
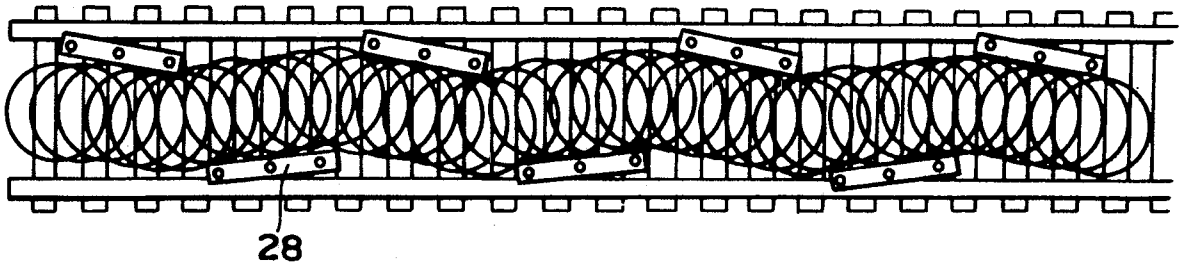
FIGS. 12(*a*) and (*b*) show schematic views illustrating the transportation of a continuously of loops of a wire rod.
Figure 12:
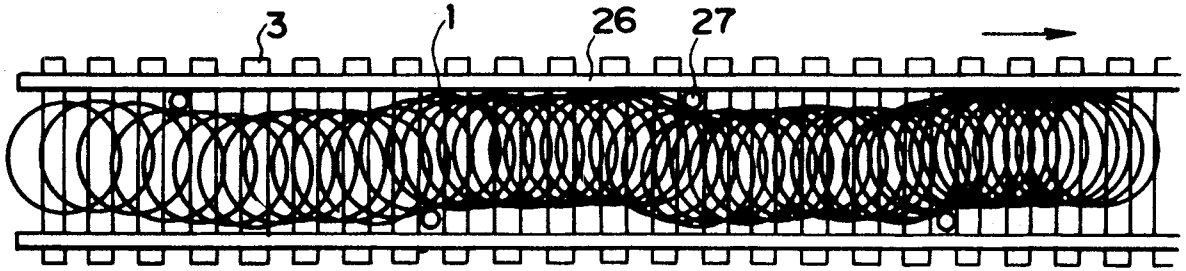
FIG. 12 (b) PRIOR ART

FIG. 11(*a*) schematically illustrates that an initial overlap point of the loops of a wire rod is gradually shifting. FIG. 11(*b*) also schematically illustrates that the wire rod is moving without an accompaning change of the relative position of the overlap points of loops of the wire rod according to the prior art method. FIG. 12 illustrates a movement of a wire rod guided by the pushing mechanism of the present invention shown in FIG. 12(*a*), in contrast with that of the wire rod guided by the vertical rollers 27 of the prior art shown in FIG. 12(*b*). From this contrast, it is clearly shown that the wire rod makes a zigzag movement by means of the pushing mechanism of the present invention. This zigzag movement was carried out on the following conditions: Air Pressure: 3.0 kgf/cm$^2$ G; Water Pressure: 2.2 kgf/cm$^2$; Air Flow: 36.3 Nm$^3$/hr; Water Flow: 14.1 l/min.; Air to Water Ratio (Air/Water): 42.9 and Speed of Blast Air: 30 m/sec.

Steel grades and chemical compositions of samples used for the zigzag movement are listed in Table 4. Steel A is piano wire SWRH 82B, Steel B is Mn-Cr-B steel for pre-stressing use and Steel C is austenite stainless steel of SUS 304. Those treated on the conditions described are listed in Table 5. Each feature of the condition of cooling is: (a): an ordinary blast air cooling; (b): the number of nozzles being so small as 30; (c): the number of nozzles being 119, but blast air is not used in parallel; (d): air-water nozzles being used together with blast air, but a pushing mechanism is not employed; (e) in addition to the conditions of (d), a pushing mechanism is employed, whereby the loops of the wire rod is moved in a zigzag, by a pushing length of 80 mm; (f) on the conditions of (e), the cooling being strengthened and after the rapid cooling heat treating being applied; (g) and (h): 160 nozzles being placed in the second cooling zone and quenching being carried out thereby, the blast air is employed in the first cooling zone and the second cooling zone, and in, (g) no zigzag movement is made and in (h), the zigzag movement is made; (i) and (j): air to water ratio being zero, namely only water spray being blown, and in (i), no zigzag movement is made and in (j), the zigzag movement is made; (k): water of 30 m/hr being blown as spray water; (l) to (p): in each of the cases, the air-water ratios, each, are gradually lowered from 250 down to 0 in the order of from (l) to (p); and (k) to (p): in each of the cases, zigzag movement is carried out, and the temperature of the water is 15° C. In Table 6, the results of the performance on the mentioned conditions are summarized. The results of the methods of the present invention are all satisfactory.

Test Nos. 1 to 6 used materials of SWRH 82B. In test No. 1, due to the exclusive use of the blast air, the cooling speed is small. For this reason, a coarse structure of pearlite is produced and the strength, as well as the ductility is low.

No. 2 used the air-water spray. But, because of the nozzles and the water flow both being small in number and amount, the strength is not satisfactorily obtained.

In No. 3, because of the air-water spray from having exclusively been used and no blast air from below having been used, the cooling speed is small. The strength is not satisfactorily obtained, either.

In No. 4, this case satisfied fundamentally the cooling conditions of the present invention, but the pushing mechanism was not used. The cooling speed is large. The maximum value and the average value of the strength is large but the minimum value thereof is small, the deviation is perceived. This is because the thick overlap portion of the loops of the wire rod is not lessened due to the lack of the use of the pushing mechanism.

No. 5 satisfied the fundamental cooling conditions of the present invention and also employed the pushing mechanism. The cooling conditions were well satisfactory. The strength and the ductility is satisfactorily high and further the deviation is small. The quality of product is well enough to match that of a lead patented wire rod.

No. 6 is an Example of the present invention which is well cooled and has good strength and ductility of more than the level of those of the lead patented wire rod. It is preferable that heat treatment is performed after the cooling so as to prevent a supercooling structure from being produced, the supercooling structure being easy to appear. It should be noted that in the ordinary lead patenting, the strength to be obtained is in the vicinity of 123 kgf/cm$^2$ and the ductility to be obtained is in the vicinity of 40%, and therefore, austenite grains of the lead patented wire rod are by far larger than those of directly patented wire rod and for this reason the ductility of the lead patented wire rod is small.

Nos. 7 and 8 are Examples of Mn-Cr-B Steel. No. 7 was not applied to by the air-water spray in the second cooling zone. Because, due to the lack of the air-water spray, the wire rod was not cooled down to a martensite transformation point and the pushing mechanism was not employed, the Controller of No. 7 is not desirable. There is a deviation of strength left. No. 8 was improved in all those disadvantageous points and the wire rod produced has high strength and high ductility with a small deviation.

No. 9 is an Example where solid solution treatment was applied to stainless steel. In this Example, there is no precipitation of carbide found and a product of low strength and high ductility is produced. This is a desirable example of the present invention.

In Nos. 10 and 11, wire rods of Mn-Cr-B steel were on the same conditions. In the case of No. 11 wherein the zigzag movement was carried out, the deviation is smaller than in No. 10. But, even if there was not the zigzag movement, the deviation almost same with that shown in No. 1 is allowable.

In the cases of Nos. 12 to 17, samples of wire rods different in diameter were used. In test No. 12 wherein water spray was used, a good mechanical property is marked.

In No. 13 wherein the test was carried out on the condition of No. 1 having a large air-water ratio, because of the cooling capacity having been slightly small and of cooling having been not uniform, the strength is low and the structure of coarse pearlite is mixedly found.

In Nos. 14 to 17, the cooling was carried out on the condition being fitted for each of the diameters of the used wire rods, any of the cases marks a good mechanical property. In the case that zigzag movement is carried out and that air-water mist cooling is also carried out, the water flow of 0.5 to 5.0 $m^3$/min. and air-water ratio of 40 to 200 $Nm^3/m^3$ are preferable. Furthermore, the cooling speed ranges preferably 15° to 30° C./sec. In the case that the zigzag movement and spray-water cooling are employed, a water flow of 0.5 to 5 $m^3$/min. is recommendable. In addition, the cooling speed also ranges preferably 15° to 30° C./sec.

Figure 13:
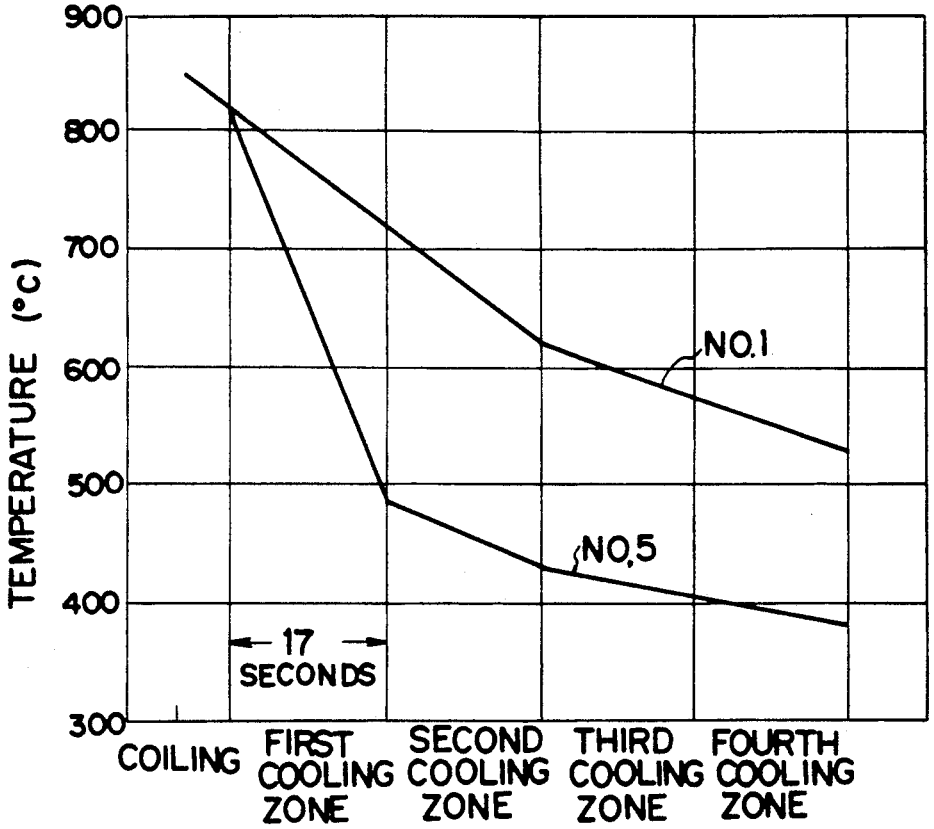
FIG. 13 is a graphic representation showing shifting of temperatures in cooling zones, depending on cooling methods to be taken in respect of the present invention.

FIG. 13 graphically represents shifting of the temperature of wire rods in two cases, namely one case being the blast air cooling of No. 1 and the other being the cooling of No. 5 of the present invention. In the blast air cooling, it takes 34 seconds to cool the wire rod down from 820° C. to 620° C., namely the average cooling speed is only about 6° C./sec. On the other hand, in the cooling in the first cooling zone of No. 5 cooling down from 800° C. to 480° C. takes 17 seconds, namely the average is 20° C./sec., being 3 times or more of that of the blast air cooling.

The method of the present invention is performed by means of a small improvement in equipment and facilities of the prior art Stelmor method and by means of employment of an efficient combination of air-water mist and blast air. The method of the present invention improves ductility of a hard wire rod and enables not only the performing of direct quenching for non-tempering prestressed concrete and also direct quenching of a dual phase wire rod, but also to produce a high strength carbon wire rod and a mild stainless wire rod.

Furthermore, in the present invention, the pushing mechanism allows for the overlap portions of the loops of the wire rod to be advanced in a zigzag movement during the transportation, the loops running continuously in series and to have the contact points of the overlap of the loops gradually slided. At the same time, during the transportation the wire rod is being cooled by means of an air-water spray from above and blast air from below both being simultaneously applied. Thus, a wire rod having a small deviation of physical property can be obtained with supply of a small amount of water.

As mentioned in the foregoing, the present invention provides a great contribution to the industry in this field.

The present invention may be embodied in other specific forms without departing from the spirit or essential characteristics thereof. The present embodiment is therefore to be considered in all respects as illustrative and not restrictive, the scope of the present invention being indicated by the appended claims rather than by the foregoing description and all changes which come within the meaning and range of equivalancy of the claims are therefore intended to be embraced.

TABLE 1

| Steel | C | Si | Mn | Ni | Cr | (wt %) B |
|---|---|---|---|---|---|---|
| Mn—B | 0.21 | 0.25 | 1.30 | — | 0.15 | 0.0023 |
| Mn—Cr—B | 0.25 | 0.24 | 1.75 | — | 0.85 | 0.0022 |
| Low C—Si—Mn | 0.08 | 0.81 | 1.55 | — | — | — |
| SUS 304 | 0.04 | 0.47 | 1.35 | 8.5 | 18.4 | — |

TABLE 2

| Cooling Condition | Sample Items | Mist from Above: Water Flow $m^3$/min | Mist from Above: Air-to-Water Ratio $Nm^3/m^3$ | Air-Blast Speed m/sec. |
|---|---|---|---|---|
| a | Stelmor | — | — | 40 |
| b | Control | 4 | 30 | 0 |
| c | Control | 0.4 | 300 | 40 |
| d | Present Invention | 4 | 30 | 40 |
| e | Control | 11 | 11 | 40 |
| f | Present Invention | 4 | 0 | 40 |
| g | Present Invention | 0.6 | 200 | 60 |
| h | Present Invention | 0.8 | 150 | 60 |
| i | Present Invention | 1.2 | 100 | 60 |
| j | Present Invention | 8 | 15 | 30 |

TABLE 3

| No. | Sample Items | Steel | Diameter mm $\phi$ | Coiling Temp. °C. | Cooling Condition | Cooling Speed °C./sec | Tensile Strength ($kgf/mm^2$) Average | Maximum | Minimum | Deviation | Structure # |
|---|---|---|---|---|---|---|---|---|---|---|---|
| 1 | Stelmor | Mn—B | 11 | 840 | a | 6 | 65 | 68 | 63 | 5 | F + P |
| 2 | Control | | | | b | 25 | 154 | 162 | 91 | 71 | M + B |
| 3 | Control | | | | c | 8 | 68 | 71 | 64 | 7 | F + P |
| 4 | Present Invention | | | | d | 31 | 160 | 164 | 156 | 8 | M |
| 5 | Control | | | | e | 40 | 162 | 166 | 157 | 9 | M |
| 6 | Stelmor | Mn—Cr—B | 11 | | a | 6 | 155 | 164 | 149 | 15 | M |
| 7 | Stelmor | Low C—Si—Mn | 9 | 780 | a | 7 | 65 | 68 | 62 | 6 | F + P |
| 8 | Control | | | | b | 28 | 90 | 95 | 72 | 23 | F + P + B |
| 9 | Control | | | | c | 9 | 68 | 72 | 63 | 9 | F + P |
| 10 | Present Invention | | | | d | 35 | 94 | 97 | 91 | 6 | B |
| 11 | Control | | | | e | 45 | 97 | 100 | 93 | 7 | B |
| 12 | Stelmor | SUS 304 | 9 | 1050 | a | 7 | 74 | 77 | 71 | 6 | Carbide Precipitation |

TABLE 3-continued

| No. | Sample Items | Steel | Diameter mm ϕ | Coiling Temp. °C. | Cooling Condition | Cooling Speed °C./sec | Tensile Strength (kgf/mm²) Average | Maximum | Minimum | Deviation | Structure # |
|---|---|---|---|---|---|---|---|---|---|---|---|
| 13 | Control | | | | b | 28 | 65 | 75 | 61 | 14 | Carbide Precipitation |
| 14 | Control | | | | c | 9 | 73 | 76 | 70 | 6 | Carbide Precipitation |
| 15 | Present Invention | | | | d | 35 | 63 | 66 | 61 | 5 | No Carbide Precipitation |
| 16 | Control | | | | e | 45 | 63 | 66 | 60 | 6 | No Carbide Precipitation |
| 17 | Present Invention | | | | f | 32 | 64 | 67 | 61 | 6 | No Carbide Precipitation |
| 18 | Present Invention | | 5.5 | 1080 | g | 19 | 64 | 66 | 61 | 5 | No Carbide Precipitation |
| 19 | Present Invention | | | | h | 23 | 63 | 67 | 61 | 6 | No Carbide Precipitation |
| 20 | Present Invention | | | | i | 30 | 62 | 65 | 59 | 6 | No Carbide Precipitation |
| 21 | Present Invention | | | | j | 40 | 63 | 66 | 61 | 5 | No Carbide Precipitation |

F: ferrite, P: pearlite, B: bainite, M: Martensite

TABLE 4

| Steel | Steel Grade | C | Si | Mn | Ni | Cr | (wt %) B |
|---|---|---|---|---|---|---|---|
| A | SWRS 82 B | 0.83 | 0.22 | 0.78 | — | 0.02 | — |
| B | Mn—Cr—B | 0.25 | 0.25 | 1.55 | — | 0.17 | 0.0021 |

TABLE 4-continued

| Steel | Steel Grade | C | Si | Mn | Ni | Cr | (wt %) B |
|---|---|---|---|---|---|---|---|
| C | SUS 304 | 0.04 | 0.46 | 1.35 | 8.6 | 18.6 | — |

TABLE 5

| Cooling Condition | Air-Water Spray: Number of Nozzles | Water Flow m³/hr | Air-Water Ratio Nm³/m³ | Air-Blast Speed in First and Second Cool. Zones | Zigzag Transportation | Treatment after Rapid Cooling |
|---|---|---|---|---|---|---|
| a | — | — | — | 30 | None | −1.5° C./sec Natural Cooling |
| b | 30 | 25 | 42.9 | 30 | None | −1.5° C./sec Natural Cooling |
| c | 119 | 101 | 42.9 | 0 | None | −1.5° C./sec Natural Cooling |
| d | 119 | 101 | 42.9 | 30 | None | −1.5° C./sec Natural Cooling |
| e | 119 | 101 | 42.9 | 30 | 80 mm Zigzag | −1.5° C./sec Natural Cooling |
| f | 160 | 135 | 42.9 | 30 | 80 mm Zigzag | +1.5° C./sec Heating |
| g | 160 | 135 | 42.9 | 30 | None | −1.5° C./sec Natural Cooling |
| h | 320 | 270 | 42.9 | 30 | 80 mm Zigzag | +1.5° C./sec Heating |
| i | 330 | 278 | 0 | 40 | None | −1.5° C./sec |
| j | 330 | 278 | 0 | 40 | 80 mm Zigzag | −1.5° C./sec Natural Cooling |
| k | 108 | 30 | 0 | 30 | 80 mm Zigzag | −1.5° C./sec Natural Cooling |
| l | 108 | 20 | 250 | 30 | 80 mm Zigzag | −1.5° C./sec Natural Cooling |
| m | 108 | 30 | 200 | 30 | 80 mm | −1.5° C./sec |

TABLE 5-continued

| Cooling Condition | Air-Water Spray: Number of Nozzles | Air-Water Spray: Water Flow $m^3/hr$ | Air-Water Spray: Air-Water Ratio $Nm^3/m^3$ | Air-Blast Speed in First and Second Cool. Zones | Zigzag Transportation | Treatment after Rapid Cooling |
|---|---|---|---|---|---|---|
| n | 108 | 52 | 100 | 30 | Zigzag 80 mm Zigzag | Natural Cooling −1.5° C./sec |
| o | 108 | 65 | 80 | 40 | Zigzag 80 mm Zigzag | Natural Cooling −1.5° C./sec |
| p | 108 | 65 | 0 | 50 | Zigzag 80 mm Zigzag | Natural Cooling −1.5° C./sec |

TABLE 6

| No. | Sample Items | Steel | Diameter mm $\phi$ | Coiling Temp. °C. | Cooling Condition | Cooling Speed °C./sec |
|---|---|---|---|---|---|---|
| 1 | Stelmor | SWRH 82B | 12 | 850 | a | 6 |
| 2 | Control | | | | b | 14 |
| 3 | Control | | | | c | 10 |
| 4 | Present Invention # | | | | d | 20 |
| 5 | Present Invention ## | | | | e | 20 |
| 6 | Present Invention ## | | | | f | 26 |
| 7 | Present Invention ⊙ | Mn—Cr—B | 12 | 850 | g | 27 |
| 8 | Present Invention ⊙⊙ | | | | h | 28 |
| 9 | Present Invention ⊙⊙ | SUS304 | 5.5 | 1050 | e | 30 |
| 10 | Present Invention # | Mn—Cr—B | 12 | 850 | i | 29 |
| 11 | Present Invention ## | | | | j | 30 |
| 12 | Present Invention | SWRH 82B | 5.5 | 840 | k | 19 |
| 13 | Control | | 7 | | l | 14 |
| 14 | Present Invention | | | | m | 20 |
| 15 | Present Invention | | 9 | | n | 20 |
| 16 | Present Invention | | 10 | | o | 21 |
| 17 | Present Invention | | | | p | 20 |

| No. | Tensile Strength ($kgf/cm^2$): Average | Maximum | Minimum | Deviation | Average of Drawing % | Micro-Structure |
|---|---|---|---|---|---|---|
| 1 | 110 | 113 | 106 | 7 | 35 | Coarse P |
| 2 | 115 | 119 | 107 | 12 | 39 | Coarse P + Fine P |
| 3 | 113 | 116 | 106 | 10 | 37 | Coarse P |
| 4 | 123 | 127 | 118 | 9 | 44 | Fine P |
| 5 | 125 | 127 | 122 | 5 | 46 | Fine P |
| 6 | 129 | 132 | 126 | 6 | 46 | Fine P |
| 7 | 151 | 155 | 140 | 15 | 61 | M |
| 8 | 153 | 157 | 148 | 9 | 60 | M |
| 9 | 63 | 65 | 61 | 4 | 70 | No Carbide |
| 10 | 157 | 164 | 145 | 19 | 58 | M |
| 11 | 160 | 165 | 154 | 11 | 57 | M |
| 12 | 125 | 128 | 123 | 5 | 50 | Fine P |
| 13 | 116 | 119 | 111 | 8 | 45 | Coarse P + Fine P |
| 14 | 126 | 129 | 125 | 4 | 49 | Fine P |
| 15 | 127 | 128 | 125 | 3 | 47 | Fine P |

TABLE 6-continued

| | | | | | | |
|---|---|---|---|---|---|---|
| 16 | 128 | 129 | 126 | 3 | 46 | Fine P |
| 17 | 127 | 129 | 124 | 5 | 46 | Fine P |

With pushing mechanisms
Without pushing mechanisms
◎ With second cooling zone spray and without pushing mechanisms
◎◎ With second cooling zone spray and pushing mechanisms

What is claimed is

1. A method for the rapid, direct cooling of a hot-rolled wire rod, comprising the steps of:

transporting a hot-rolled and coiled wire rod on a conveyer, said wire rod being in a form of continuous series of loops; and blasting an air-water mist to said wire rod and simultaneously blasting air to the back side of said wire rod from below to cool said wire rod at a cooling rate of 10° to 100° C./sec. while transporting said wire rod on said conveyer, said air-water mist providing 0.5 to 10 $m^3$/minute water and having an air to water ratio of 200 $Nm^3/m^3$ or less.

2. The method of claim 1, wherein said mist is blasted to said wire rod from above.

3. The method of claim 1, wherein said mist is blasted to said wire rod from below.

4. The method of claim 1, wherein said cooling rate is 15° to 40° C./sec.

5. The method of claim 4, wherein said blasting air has a velocity of 10 to 60 m/sec.

6. The method of claim 1, wherein said air-water mist provides 0.6 to 2 $m^3$/minute water and has an air to water ratio of 100 to 200 $Nm^3/m^3$.

7. The method of claim 1, wherein said air-water mist provides 2 to 8 $m^3$/minute water and has an air to water ratio of 15 to 50 $Nm^3/m^3$.

8. The method of claim 1, which further comprises the additional step of controlling a temperature of said water from 10° to 30° C.

9. A method for the rapid, direct cooling of a hot-rolled wire rod, comprising the steps of:

transporting a hot-rolled and coiled wire rod on a conveyer, said wire rod being in a form of continuous series of loops; and blasting spray-water to said wire rod and simultaneously blasting air to the back side of said wire rod from below to cool said wire rod at a cooling rate of 10° to 100° C./sec. while transporting said wire rod on said conveyer, said spray-water being in the form of fine particles by means of spraying and providing 0.5 to 10 $m^3$/minute water.

10. The method of claim 9, wherein said spray-water is blasted to said wire rod from above.

11. The method of claim 9, wherein said spray-water is blasted to said wire rod from below.

12. The method of claim 9, wherein said cooling rate is 15° to 40° C./sec.

13. The method of claim 12, wherein said blasting air has a velocity of 10 to 60 m/sec.

14. The method of claim 9, which further comprises the additional step of controlling a temperature of said water from 10° to 30° C.

15. A method for the rapid, direct cooling of a hot-rolled wire rod comprising the steps of:

transporting a hot-rolled and coiled wire rod on a conveyer, said wire rod being in a form of continuous series of loops, advancing said wire rod in a zigzag configuration during the transportation; and blasting an air-water mist to said wire road and simultaneously blasting air to the back side of said wire rod from below to cool said wire rod at a cooling rate of 10° to 100° C./sec. while transporting said wire rod on said conveyer, said air-water mist providing 0.5 to 10 $m^3$/minute water and having an air to water ratio of 200 $Nm^3/m^3$ or less.

16. The method of claim 15, wherein said transporting comprises pushing the wire rod in turns toward one side of the conveyer and towards the other side by a guide means placed at each side of the conveyer during the transportation.

17. The method of claim 16, wherein said pushing the wire rod towards one side includes pushing the wire rod by a pushing length of 30 to 100 mm.

18. The method of claim 15, wherein said mist is blasted to said wire rod from above.

19. The method of claim 15, wherein said mist is blasted to said wire rod from below.

20. The method of claim 15, wherein said cooling rate is 15° to 30° C./sec.

21. The method of claim 20, wherein said blasting air has a velocity of 10 to 60 m/sec.

22. The method of claim 15, wherein said air-water mist provides 0.5 to 5.0 $m^3$/minute water and has an air to water ratio of 40 to 200 $Nm^3/m^3$.

23. The method of claim 15, which further comprises the additional step of controlling a temperature of said water from 10° to 30° C.

24. The method of claim 23, wherein said pushing of the wire rod towards one side includes pushing the wire rod for a length of 30 to 100 mm and said cooling rate is 15° to 30° C./sec.

25. A method for the rapid, direct cooling of a hot-rolled wire rod, comprising the steps of:

transporting a hot-rolled and coiled wire rod on a conveyer, said wire rod being in a form of continuous series of loops, advancing said wire in a zigzag configuration during the transportation; and blasting spray-water to said wire rod and simultaneously blasting air to the back side of said wire rod from below to cool said rod at a cooling rate of 10° to 100° C./sec. said spray-water being in the form of fine particles by means of spraying and providing 0.5 to 10 $m^3$/minute water.

26. The method of claim 25, wherein said blasting air has a velocity of 10 to 60 m/sec.

27. The method of claim 26, wherein said cooling rate is 15° to 40° C./sec. and said air-water mist provides 2 to 8 $m^3$/minute water and has an air to water ratio of 15 to 50 $Nm^3/m^3$.

28. The method of claim 25, wherein said transporting comprising pushing the wire rod in turns toward done side of the conveyer and towards the other side by a guide means placed at each side of the conveyer during the transportation.

29. The method of claim 28, wherein said pushing the wire rod towards one side includes pushing the wire rod by a pushing length of 30 to 100 mm.

30. The method of claim 25, wherein said spray-water is blasted to said wire rod from above.

31. The method of claim 25, wherein said spray-water is blasted to said wire rod from below.

32. The method of claim 25, which further comprises the additional step of controlling a temperature of said water from 10° to 30° C.

33. The method of claim 25, wherein said spray-water is provides 0.5 to 5.0 $m^3$/min. water.

* * * * *

UNITED STATES PATENT AND TRADEMARK OFFICE

CERTIFICATE OF CORRECTION

PATENT NO. : 5,146,759

DATED : September 15, 1992

INVENTOR(S) : EGUCHI et al

It is certified that error appears in the above-identified patent and that said Letters Patent is hereby corrected as shown below:

Column 1, line 42: after "methods" insert --have been proposed--.

Column 1, line 42: after "method" delete "have been proposed".

Column 6, line 38: after "operation," delete "in" and insert -- in- --.

Column 7, line 62: delete "cases" and insert --case--.

Column 9, line 18: delete "given" and insert --described--.

Column 9, line 28: delete "Table 22" and insert --Table 2--.

Signed and Sealed this

Twenty-third Day of August, 1994

Bruce Lehman

*Attest:*

BRUCE LEHMAN

*Attesting Officer*

*Commissioner of Patents and Trademarks*